US007971637B2

(12) United States Patent
Duhon et al.

(10) Patent No.: US 7,971,637 B2
(45) Date of Patent: Jul. 5, 2011

(54) DUAL MINI WELL SURFACE CONTROL SYSTEM

(75) Inventors: Bryan Lee Duhon, Church Point, LA (US); Wayne Ducote, Houston, TX (US)

(73) Assignee: Devin International, Inc., Houston, TX (US)

( * ) Notice: Subject to any disclaimer, the term of this patent is extended or adjusted under 35 U.S.C. 154(b) by 217 days.

(21) Appl. No.: 12/393,769

(22) Filed: Feb. 26, 2009

(65) Prior Publication Data

US 2010/0212881 A1 Aug. 26, 2010

(51) Int. Cl.
*E21B 34/02* (2006.01)
*E21B 29/04* (2006.01)

(52) U.S. Cl. ..... 166/54.5; 166/76.1; 166/95.1

(58) Field of Classification Search ..... 166/88.1, 166/80.1, 90.1, 91.1, 95.1, 54.5, 76.1
See application file for complete search history.

(56) References Cited

U.S. PATENT DOCUMENTS 3,960,215 A 6/1976 Mitchell
5,246,203 A 9/1993 McKnight et al.
6,109,353 A * 8/2000 Edwards et al. ..... 166/367
6,152,229 A * 11/2000 Jennings ..... 166/321
7,163,064 B2 1/2007 Moncus
2002/0074125 A1 6/2002 Fikes et al.
2006/0060360 A1 3/2006 Moncus et al.

OTHER PUBLICATIONS

International Search Report corresponding to International Application No. PCT/US2010/025069.
Written Opinion of the International Searching Authority corresponding to International Application No. PCT/US2010/025069.

* cited by examiner

*Primary Examiner* — Kenneth Thompson
(74) *Attorney, Agent, or Firm* — Jones Walker

(57) ABSTRACT

A well surface control system for use with various types of work strings such as, but not limited to, drill strings, coiled tubing, snubbing pipe, electric line, production tubing, and wireline. The system includes a main housing with a main bore extending from one end to the other. The main housing is equipped with a side port which communicates with the main bore between the two ends. The main housing is also equipped with two valves for controlling fluid and/or gas flows through the main bore and for severing a component of a work string running through the main bore. The first valve is positioned between the side port and one end of the main housing and the second valve is positioned between the side port and the other end of the main housing. Attached to each end of the main housing is a saver sub, with means for temporarily locking the saver subs to the main housing to prevent circular and longitudinal movement of the saver subs in relation to the main housing.

17 Claims, 3 Drawing Sheets

DUAL MINI WELL SURFACE CONTROL SYSTEM

FIELD OF THE INVENTION

The subject invention relates generally to an apparatus for controlling a well on a rig or platform.

BACKGROUND OF THE INVENTION

In the course of drilling, completing, and producing subterranean reservoirs, operators find it necessary to rig up and run into a well various types of work strings. Examples of work strings include, but are not limited to, drill strings, coiled tubing, snubbing pipe, electric line, production tubing, and wireline.

When working with subterranean reservoirs, operators are always concerned about the high pressure that may exist in such reservoirs. These high pressures may reach several thousands of pounds per square inch. Thus, during any type of operation involving work strings that are run into a well, operators will employ various types of valves at the surface of the well to isolate the crew members working on the well from the high pressure within the reservoir.

SUMMARY OF THE INVENTION

The present invention is a well surface control system for use with various types of work strings such as, but not limited to, drill strings, coiled tubing, snubbing pipe, electric line, production tubing, and wireline. The preferred embodiment of the present invention includes a main housing having a longitudinal axis, an outer wall, a first end, and a second end. A main bore extends through the main housing along the longitudinal axis from the first end to the second end of the main housing. The main housing is equipped with a side port through the outer wall of the main housing in communication with the main bore between the first end and the second end of the main housing. The main housing is also equipped with two valves for controlling fluid and/or gas flows through the main bore and for severing components of a work string running through the main bore. The first valve is positioned between the side port and the first end of the main housing and the second valve is positioned between the side port and the second end of the main housing. Attached to each end of the main housing is a saver sub, with means for temporarily locking the saver subs to the main housing to prevent circular and longitudinal movement of the saver subs in relation to the main housing.

An advantage of the present invention is that it provides a single, compact system for controlling pressure in a well and for severing components of a work string. Another advantage of the present invention is that it provides a locking mechanism to keep crossovers securely connected to the system in a derrick of a rig. Still another advantage of the present invention is that it can be quickly and easily connected to any type work string. Yet another advantage of the present invention is that it provides a faster rig-up and rig-down time than conventional blow out preventers.

BRIEF DESCRIPTION OF THE DRAWINGS

The accompanying drawings are provided for the purpose of illustration only and are not intended as a definition of the limits of the present invention. The drawings illustrate a preferred embodiment of the present invention, wherein.

DESCRIPTION OF THE INVENTION

While the present invention will be described with reference to preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the present invention not be limited to the particular embodiments disclosed as the best mode contemplated for carrying out this invention, but that the invention will include all embodiments (and legal equivalents thereof) falling within the scope of the appended claims.

Figure 1:
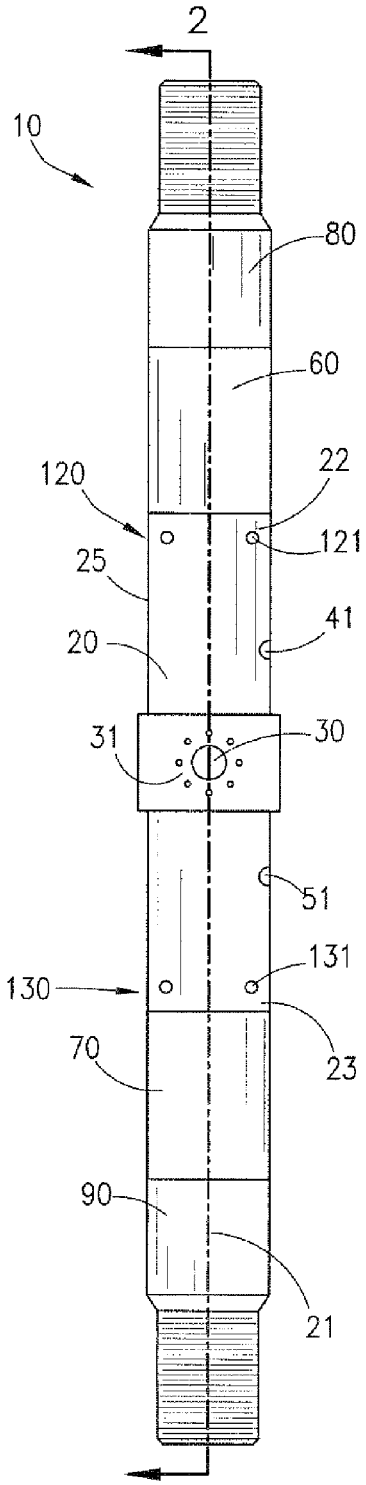
FIG. 1 is a side view of one preferred embodiment of the present invention.
Figure 2:
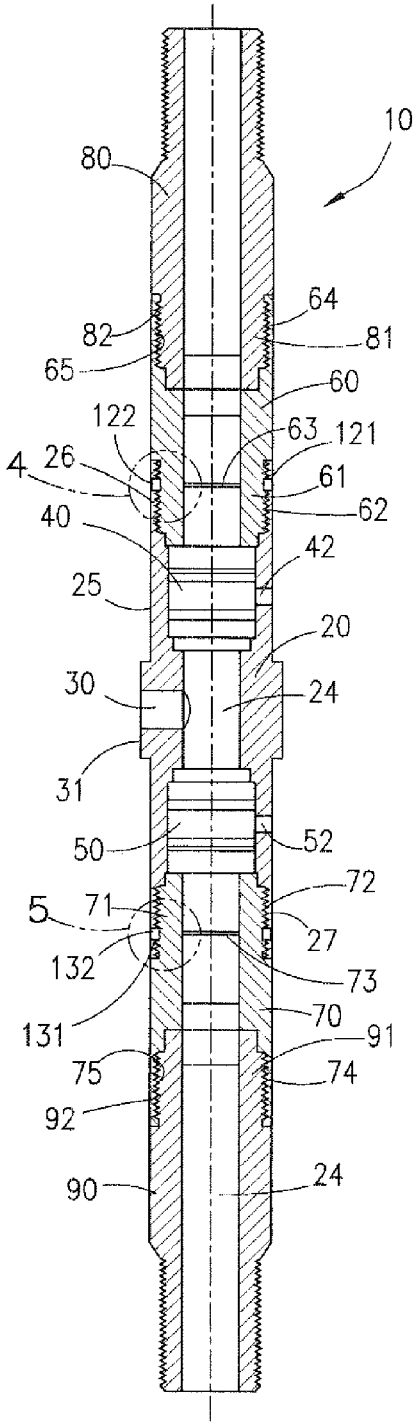
FIG. 2 is a cross-sectional view of one preferred embodiment of the present invention.

A preferred embodiment of the present invention is shown in FIGS. 1 and 2. Well surface control system 10 includes a main housing 20, wherein said main housing 20 has a longitudinal axis 21, a first end 22, a second end 23, and an outer wall 25. Referring to FIG. 2, main bore 24 extends generally along longitudinal axis 21 from first end 22 to second end 23 of main housing 20.

Figure 3:
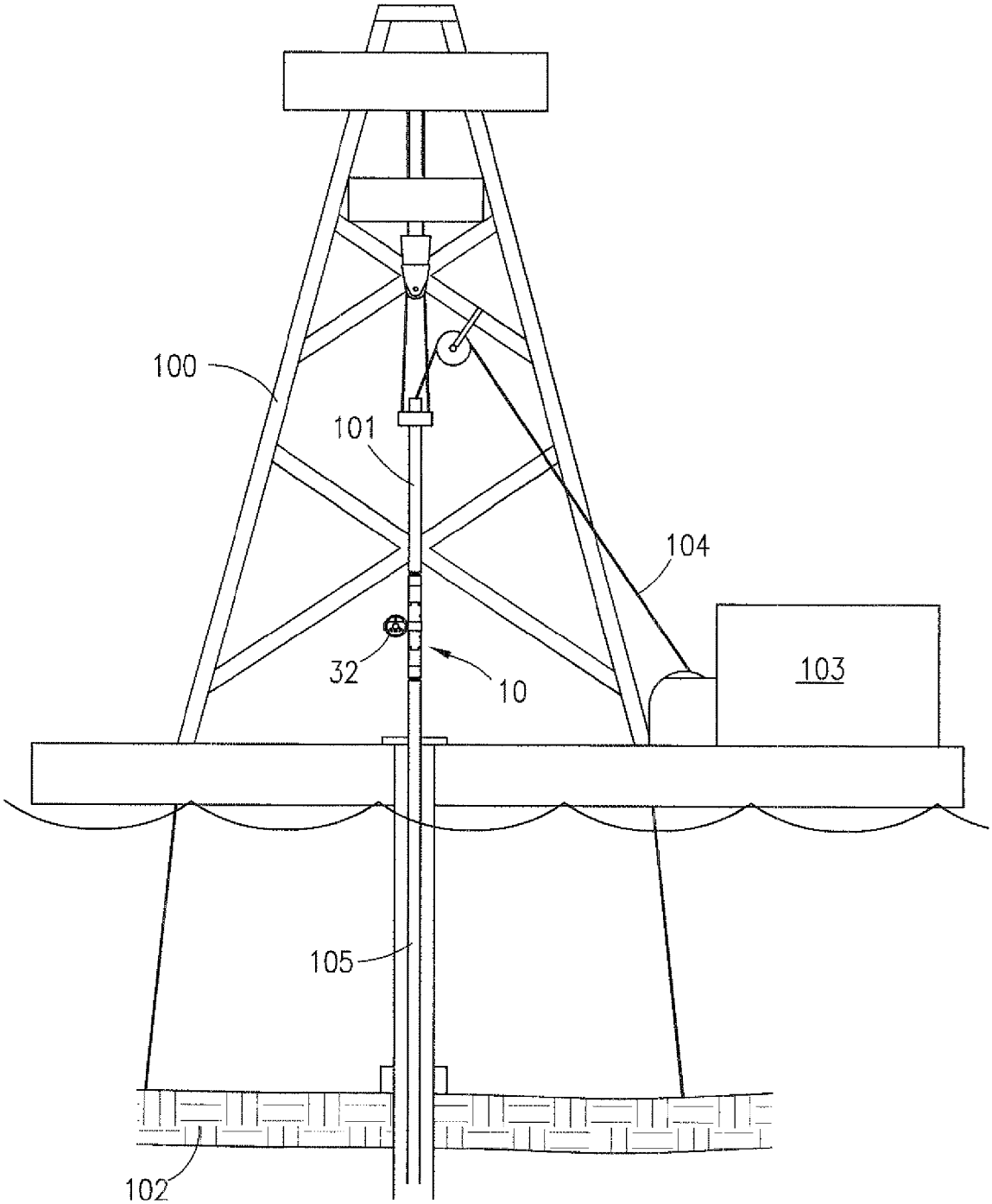
FIG. 3 is a schematic of the one preferred embodiment of the present invention rigged up to a well on a rig.
Figure 4:
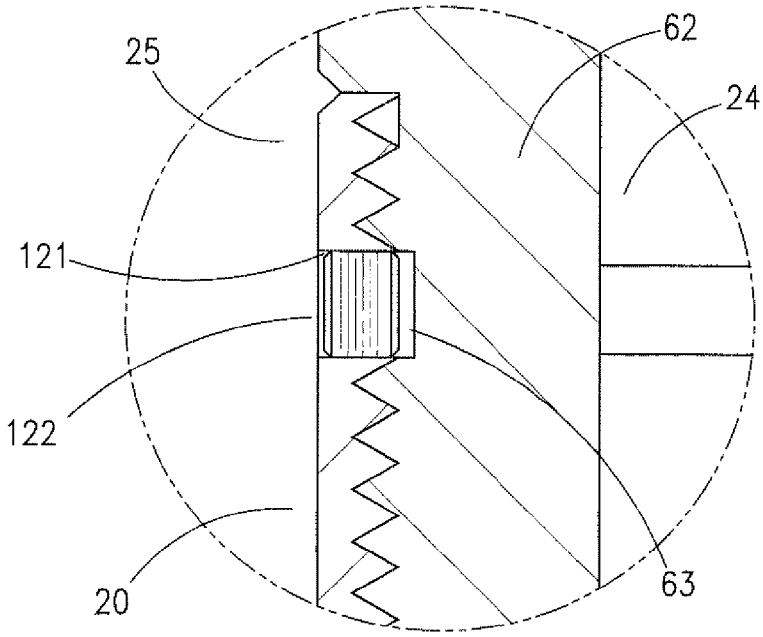
FIG. 4 is a cross-sectional view of a portion of the embodiment of the present invention showing the first locking system.
Figure 5:
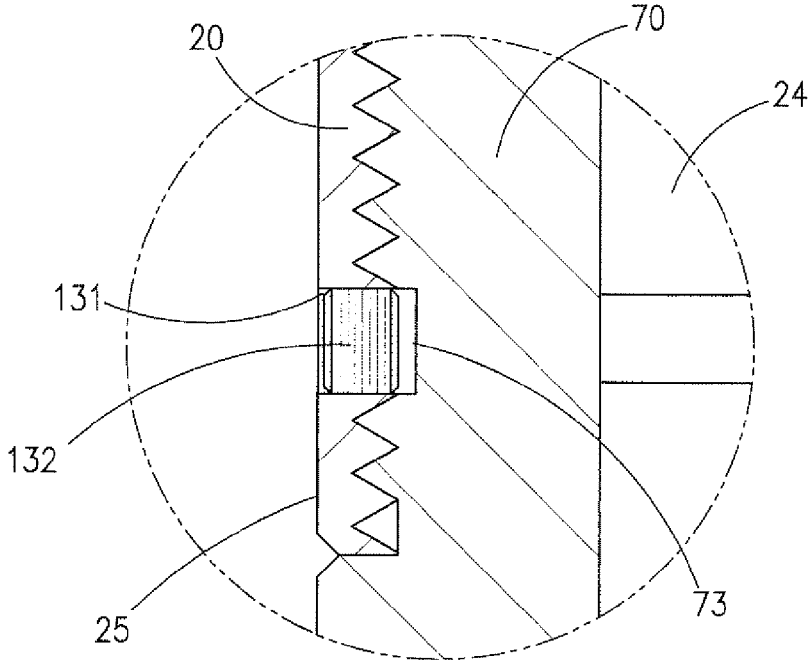
FIG. 5 is a cross-sectional view of a portion of the embodiment of the present invention showing the second locking system.

Main housing 20 is preferably equipped with a side port 30 through outer wall 25, which can serve as an inlet or outlet for fluids flowing through main bore 24 into or out of a well. Side port 30 can be equipped with a flange interface 31, as shown in FIG. 1, for connecting a valve 32 and/or other flow control equipment, as shown in FIG. 3. Flange interface 31 is an improvement over the prior art in that it virtually eliminates the risk of valves and other flow control equipment being inadvertently disconnected from side port 30.

Side port 30 can be connected to a tank for receiving fluids and/or gas exiting the well, or connected to a pump for introducing fluids, such as a kill fluid, into the well for controlling the pressure of the reservoir inside the well. As understood by those of ordinary skill in the art, the hydrostatic head of the fluid introduced into the well suppresses reservoir pressure and, thus, the term "kill fluid" is used in this context.

As shown in FIG. 2, main housing 20 is preferably equipped with a first valve 40 and a second valve 50 for controlling fluid and/or gas flows through main bore 24 and for severing components of a work string 101 (shown in FIG. 3) running through main bore 24, as discussed in more detail below. First valve 40 is preferably positioned generally along longitudinal axis 21 of main housing 20, between side port 30 and first end 22 of main housing 20. Second valve 50 is preferably positioned generally along longitudinal axis 21 of main housing 20, between side port 30 and second end 23 of main housing 20.

First valve 40 and second valve 50 are preferably M&M Canister Guard ball valves commercially available from M&M International, as disclosed in U.S. Pat. No. 5,246,203 assigned to M&M Supply Co. (incorporated herein by reference). It should be understood that any valves that perform the functions of controlling fluid flow through main bore 24 and severing components of a work string 101 running through main bore 24 are acceptable for purposes of the preferred embodiment of the present invention.

Referring to FIGS. 1 and 2, main housing 20 contains an opening 41 through outer wall 25 for accessing valve stem 42 of first valve 40 so that the valve mechanism of first valve 40 may be manipulated. Main housing 20 also contains an opening 51 through outer wall 25 for accessing valve stem 52 of second valve 50 so that the valve mechanism of second valve 50 may be manipulated. In the preferred embodiment, valve stems 42 and 52 are flush with or recessed within the outer wall 25 of main housing 20, as shown in FIGS. 1 and 2. The flush or recessed valve stems 42 and 52 are an improvement over the prior art in that they create a more streamline profile for well surface control system 10, and they minimize the potential for damage to valve stems 42 and 52.

The valve mechanisms of first valve 40 and second valve 50 can be manipulated either manually or mechanically. In either case, the valves are opened or closed by turning valve stems 42 and 52. One method of mechanically manipulating the valve mechanisms of first valve 40 and second valve 50 is by hydraulic control means, as understood by those of ordinary skill in the art.

In the preferred embodiment, first end 22 has a threaded drill pipe box 26, as shown in FIG. 2. A first saver sub 60, having a male end 61 with a threaded drill pipe pin 62, is preferably connected to threaded drill pipe box 26 of first end 22. Well surface control system 10 is preferably equipped with a locking system 120 for keeping first saver sub 60 securely threaded to first end 22. Locking system 120 includes at least one hole 121 through outer wall 25 of main housing 20 which communicates with main bore 24 near first end 22 of main housing 20, as shown in FIGS. 1, 2, 4 and 5. Locking system 120 also includes a circumferential groove 63 in threaded drill pipe 62 of first saver sub 60, wherein, when first saver sub 60 is completely threaded into first end 22 of main housing 20, circumferential groove 63 is laterally aligned with hole 121 near first end 22 of main housing 20. Locking system 120 further includes a dowel 122, which removably extends through hole 121 and engages circumferential groove 63 in threaded drill pipe box 62 of first saver sub 60. Hole 121 can be equipped with female threads to coincide with male threads on dowel 122 to hold dowel 122 firmly against circumferential groove 63. In this position, dowel 122 minimizes the longitudinal and rotational movement of first saver sub 60 in relation to main housing 20.

Likewise, in the preferred embodiment, second end 23 has a threaded drill pipe box 27, as shown in FIG. 2. A second saver sub 70, having a male end 71 with a threaded drill pipe pin 72, is preferably connected to threaded drill pipe box 27 of second end 23. Well surface control system 10 is preferably equipped with a locking system 130 for keeping second saver sub 70 securely threaded to second end 23. Locking system 130 includes at least one hole 131 through outer wall 25 of main housing 20 which communicates with main bore 24 near second end 23 of main housing 20, as shown in FIGS. 1, 2, 4 and 5. Locking system 130 also includes a circumferential groove 73 in threaded drill pipe 72 of second saver sub 70, wherein, when second saver sub 70 is completely threaded into second end 23 of main housing 20, circumferential groove 73 is laterally aligned with hole 131 near second end 23 of main housing 20. Locking system 130 further includes a dowel 132, which removably extends through hole 131 and engages circumferential groove 73 in threaded drill pipe box 72 of second saver sub 70. Hole 131 can be equipped with female threads to coincide with male threads on dowel 132 to hold dowel 132 firmly against circumferential groove 73. In this position, dowel 132 minimizes the longitudinal and rotational movement of second saver sub 70 in relation to main housing 20.

In the preferred embodiment of the present invention, first saver sub 60 has a female end 64 with a threaded drill pipe box 65. A first crossover sub 80 having a male end 81 with a threaded drill pipe pin 82 can be connected to female end 64 of first saver sub 60. Different first crossover subs 80 having a second end 83 that can vary in size can be connected to first saver sub 60 to accommodate different work strings, such as, for example, but not by way of limitation, a 7" 29# Hydril 563 Box, or a 5½" 20# VAM Top HC Box, or a 6" 30.9# VAM Top HC KA Box, or a 5⅞" XT-M57 Box, or the like.

In the preferred embodiment of the present invention, second saver sub 70 has a female end 74 with a threaded drill pipe box 75. A second crossover sub 90 having a male end 91 with a threaded drill pipe pin 92 can be connected to female end 74 of second saver sub 70. Different second crossover subs 90 having a second end 93 that can vary in size can be connected to second saver sub 70 to accommodate different work strings, such as, for example, but not by way of limitation, a 7" 29# Hydril 563 Pin, or a 5½" 20# VAM Top HC Pin, or a 6" 30.9# VAM Top FTC KA Pin, or a 5⅞" XT-M57 Pin, or the like.

In the open position, first valve 40 and second valve 50 allow fluid flow through main bore 24 (and through side port 30, if desirable) in either the up hole or down hole scenario. In addition, while in the open position, first valve 40 and second valve 50 allow operators to raise or lower various types of work strings, such as, for example, drill strings, coiled tubing, snubbing pipe, electric line, production tubing, and wireline, through well surface control system 10, as is readily understood by those of ordinary skill in the art.

Referring now to FIG. 3, a schematic of the preferred embodiment of well surface control system 10 operatively rigged up to a well on a floating rig 100 will now be described. The well is completed to a subterranean reservoir 102, wherein the reservoir 102 is under pressure and the pressure is communicated to the well. The schematic of FIG. 3 shows that a coiled tubing unit 103 is rigged up on the floating rig 100, wherein the coiled tubing 104 can be run into the well through the well surface control system 10. A tubular string 105 is shown within the well and wherein the coiled tubing 104 may be concentrically disposed within the tubular string 105, as well understood by those of ordinary skill in the art. It should be understood that other types of work strings can be employed and run through the well surface control system 10, such as snubbing pipe, wire line, electric line, drill pipe, production tubing, etc.

During well intervention work, when first valve 40 and second valve 50 are in the open position, there are occasions when high-pressure fluid will begin to flow up the well. On these occasions, well surface control system 10 can control the pressure and flow of fluid from within the well by closing second valve 50 and first valve 40. These valves can be actuated either hydraulically, remotely, mechanically, pneumatically, or electronically. In the preferred embodiment, particularly during wireline operations, the closing of first valve 40 and second valve 50 will sever the wireline or other components of a work string, which avoids having to remove the wireline or work string from the well before closing first valve 40 and second valve 50.

During producing and pumping stages, well surface control system 10 can be used to release pressure from within the well by closing first valve 40 and opening second valve 50 and valve 32 to release pressure into a tank (not shown). As readily understood by those of ordinary skill in the art, the operator may also choose to pump fluids into the well through valve 32 and second valve 50 (while first valve 40 is closed). The operator can pump a fluid, such as a weighted fluid, to control the pressure in the well. The weighted fluid is sometimes referred to as a kill fluid. Once the well pressure is under control by the operator, first valve 40 can be opened, after which a work string, such as a coiled tubing, can then be concentrically lowered through well surface control system 10 and the tubular string 105, thereby allowing operations can continue.

Although this invention has been disclosed and described in its preferred forms with a certain degree of particularity, it is understood that the present disclosure of the preferred forms is only by way of example and that numerous changes in the details of construction and operation and in the combination and arrangement of parts may be resorted to without departing from the spirit and scope of the invention as hereinafter claimed.

What is claimed is:

1. A surface control system for a well, comprising:

a main housing having a longitudinal axis, an outer wall, a first end, and a second end;

a main bore extending through said main housing along said longitudinal axis, wherein said main bore extends from said first end to said second end of said main housing;

a side port through said main bore between said first end and said second end of said main housing, said side port being equipped with a flange interface;

a first valve for controlling a fluid or gas flow through said main bore and for severing a work string running through said main bore, wherein said first valve is positioned between said side port and said first end of said main housing; and a second valve for controlling said fluid or gas flow through said main bore and for severing said work string running through said main bore, wherein said second valve is positioned between said side port and said second end of said main housing.

2. The surface control system of claim 1, wherein said first end and said second end of said main housing are each equipped with a threaded connection.

3. The surface control system of claim 2, further comprising:

a first saver sub threadedly connected to said threaded connection of said first end of said main housing;

a means for temporarily locking said first saver sub to said first end of said main housing;

a second saver sub threadedly connected to said threaded connection of said second end of said main housing; and a means for temporarily locking said second saver sub to said second end of said main housing.

4. The surface control system of claim 3, wherein each of said threaded connections of said first end and said second end of said main housing is a female threaded connection.

5. The surface control system of claim 4, wherein said means for temporarily locking said first saver sub to said first end of said main housing comprises:

a hole through said outer wall of said main housing near said first end of said main housing;

a circumferential groove in said first saver sub that laterally aligns with said hole near said first end of said main housing when said first saver sub is completely threadedly connected to said first end of said main housing; and a removable dowel extending through said hole and engaging said circumferential groove when said first saver sub is completely threadedly connected to said first end of said main housing, whereby said removable dowel minimizes longitudinal and rotational movement of said first saver sub in relation to said main housing.

6. The surface control system of claim 5, wherein said means for temporarily locking said second saver sub to said second end of said main housing comprises:

a hole through said outer wall of said main housing near said second end of said main housing;

a circumferential groove in said second saver sub that laterally aligns with said hole near said second end of said main housing when said second saver sub is completely threadedly connected to said second end of said main housing; and a removable dowel extending through said hole and engaging said circumferential groove when said second saver sub is completely threadedly connected to said second end of said main housing, whereby said removable dowel minimizes longitudinal and rotational movement of said second saver sub in relation to said main housing.

7. The surface control system of claim 6, further comprising:

a female crossover sub connected to said first saver sub; and a male crossover sub connected to said second saver sub.

8. The surface control system of claim 7, wherein each of said first and second valves has a valve stems stem that is flush with said outer wall of said main housing.

9. The surface control system of claim 8, wherein each of said valve stems of said first and second valves is recessed from said outer wall of said main housing.

10. The surface control system of claim 9, wherein each of said first and second valves is manually operated.

11. The surface control system of claim 10, wherein each of said first and second valves is operated hydraulically, remotely, mechanically, pneumatically, or electronically.

12. A surface control system for a well, comprising:

a main housing having a longitudinal axis, an outer wall, a first end, and a second end, wherein each of said first and second ends is equipped with a threaded drill pipe box;

a main bore extending through said main housing along said longitudinal axis, wherein said main bore extends from said first end to said second end of said main housing;

a side port through said outer wall of said main housing in communication with said main bore between said first end and said second end of said main housing;

a first modular canister ball valve for controlling a fluid or gas flow through said main bore and for severing a work string running through said main bore, wherein said first modular canister ball valve is positioned between said side port and said first end of said main housing; and a second modular canister ball valve for controlling said fluid or gas flow through said main bore and for severing said work string running through said main bore, wherein said second modular canister ball valve is positioned between said side port and said second end of said main housing;

a first saver sub threadedly connected to said threaded drill pipe box of said first end of said main housing;

a means for temporarily locking said first saver sub to said first end of said main housing;

a second saver sub threadedly connected to said threaded drill pipe box of said second end of said main housing; and a means for temporarily locking said second saver sub to said second end of said main housing.

13. The surface control system of claim 12, wherein said means for temporarily locking said first saver sub to said first end of said main housing comprises:

a hole through said outer wall of said main housing near said first end of said main housing;

a circumferential groove in said first saver sub that laterally aligns with said hole near said first end of said main housing when said first saver sub is completely threadedly connected to said first end of said main housing; and a removable dowel extending through said hole and engaging said circumferential groove when said first saver sub is completely threadedly connected to said first end of said main housing, whereby said removable dowel minimizes longitudinal and rotational movement of said first saver sub in relation to said main housing.

14. The surface control system of claim 13, wherein said means for temporarily locking said second saver sub to said second end of said main housing comprises:

a hole through said outer wall of said main housing near said second end of said main housing;

a circumferential groove in said second saver sub that laterally aligns with said hole near said second end of said main housing when said second saver sub is completely threadedly connected to said second end of said main housing; and a removable dowel extending through said hole and engaging said circumferential groove when said second saver sub is completely threadedly connected to said second end of said main housing, whereby said removable dowel minimizes longitudinal and rotational movement of said second saver sub in relation to said main housing.

15. The surface control system of claim 14, further comprising;

a female crossover sub connected to said first saver sub; and a male crossover sub connected to said second saver sub.

16. The surface control system of claim 15, wherein each of said first and second modular canister ball valves is manually operated.

17. The surface control system of claim 16, wherein each of said first and second modular canister ball valves is operated hydraulically, remotely, mechanically, pneumatically, or electronically.

* * * * *